US008226272B2

(12) United States Patent
Chen

(10) Patent No.: US 8,226,272 B2
(45) **Date of Patent: *Jul. 24, 2012**

(54) ILLUMINATING EQUIPMENT USING HIGH POWER LED WITH HIGH EFFICIENCY OF HEAT DISSIPATION

(75) Inventor: Jen-Shyan Chen, Hsinchu (TW)

(73) Assignee: Neobulb Technologies, Inc. (BN)

( * ) Notice: Subject to any disclaimer, the term of this patent is extended or adjusted under 35 U.S.C. 154(b) by 105 days.

This patent is subject to a terminal disclaimer.

(21) Appl. No.: 12/763,595

(22) Filed: Apr. 20, 2010

(65) Prior Publication Data

US 2010/0202145 A1 Aug. 12, 2010

Related U.S. Application Data

(63) Continuation of application No. 11/887,433, filed on Sep. 28, 2007, now Pat. No. 7,726,844.

(30) Foreign Application Priority Data

Mar. 31, 2005 (CN) ..... 2005 2 0004571 U
Mar. 31, 2005 (WO) ..... PCT/CN2005/000428

(51) Int. Cl.
*F21V 29/00* (2006.01)

(52) U.S. Cl. ..... 362/294; 362/218; 362/249.02

(58) Field of Classification Search ..... 362/218, 362/249.02, 294, 373, 547
See application file for complete search history.

(56) References Cited

U.S. PATENT DOCUMENTS 6,220,722 B1 * 4/2001 Begemann ..... 362/294
6,382,307 B1 * 5/2002 Wang et al. ..... 165/80.3
6,465,961 B1 10/2002 Cao
6,880,956 B2 * 4/2005 Zhang ..... 362/294
6,897,486 B2 5/2005 Loh
6,910,794 B2 * 6/2005 Rice ..... 362/547
7,083,305 B2 8/2006 Galli
7,314,291 B2 * 1/2008 Tain et al. ..... 362/373
7,438,448 B2 * 10/2008 Chen ..... 362/373
7,726,844 B2 * 6/2010 Chen ..... 362/373
7,891,837 B2 * 2/2011 Chen ..... 362/294
2002/0176250 A1 11/2002 Bohler
2004/0120152 A1 6/2004 Bolta
2004/0212991 A1 10/2004 Galli (Continued)

FOREIGN PATENT DOCUMENTS

CN 2458485 11/2001

(Continued)

OTHER PUBLICATIONS

Office Action in related Australian Patent Application dated Aug. 12, 2010.

(Continued)

*Primary Examiner* — Y My Quach Lee

(74) *Attorney, Agent, or Firm* — Thomas, Kayden, Horstemeyer & Risley, LLP.

(57) ABSTRACT

The invention provides a packaged system that is suitable for a LED package of high power. The packaged system further includes a heat-conducting device surrounded by at least one heat-dissipating fin to effectively dissipate the heat generated by the high power LED package. The packaged system with high efficiency of heat dissipation can be incorporated into various projecting illuminating equipments, such as a flashlight or floodlight, by simply installing the present invention into a housing and providing power connection thereto.

5 Claims, 22 Drawing Sheets

U.S. PATENT DOCUMENTS

| | | | |
|---|---|---|---|
| 2004/0213016 | A1 | 10/2004 | Rice |
| 2005/0024746 | A1 | 2/2005 | Shimura |
| 2005/0120512 | A1 | 6/2005 | Choi |
| 2005/0231983 | A1 | 10/2005 | Dahm |
| 2005/0279949 | A1 | 12/2005 | Oldham |
| 2006/0092639 | A1 | 5/2006 | Livesay |
| 2006/0100496 | A1 | 5/2006 | Avron |

FOREIGN PATENT DOCUMENTS

| | | |
|---|---|---|
| CN | 1335047 | 2/2002 |
| CN | 1359137 | 7/2002 |
| CN | 2520091 | 11/2002 |
| CN | 2557805 | 6/2003 |
| CN | 2564849 | 8/2003 |
| CN | 1447984 | 10/2003 |
| CN | 2634264 | 8/2004 |
| CN | 1524705 | 9/2004 |
| CN | 2641451 | 9/2004 |
| CN | 2644878 | 9/2004 |
| CN | 1538538 | 10/2004 |
| CN | 2677742 | 2/2005 |
| CN | 2685703 | 3/2005 |
| CN | 1605795 | 4/2005 |
| CN | 1622351 | 6/2005 |
| CN | 1680749 | 10/2005 |
| CN | 1731593 | 2/2006 |
| CN | 1788359 | 6/2006 |
| CN | 1808714 | 7/2006 |
| CN | 1830082 | 9/2006 |
| CN | 1840258 | 10/2006 |
| CN | 1866500 | 11/2006 |
| CN | 1869504 | 11/2006 |
| CN | 1871014 | 11/2006 |
| CN | 2881958 | 3/2007 |
| EP | 1067164 | 1/2001 |
| GB | 638013 | 5/1950 |
| JP | 2005093097 | 4/2005 |
| TW | 549590 | 8/2003 |
| WO | 2005017409 | 2/2005 |
| WO | 2006002603 | 1/2006 |

OTHER PUBLICATIONS

English Abstract of WO2005017409, Feb. 24, 2005.
English Abstract of CN2520091, Nov. 6, 2002.
English Abstract of CN1680749, Oct. 12, 2005.
English Abstract of CN2685703, Mar. 16, 2005.
English Abstract of CN1359137, Jul. 7, 2002.
English Abstract of 1538538, Oct. 20, 2004.
English Abstract of CN2557805, Jun. 25, 2003.
English Abstract of CN2564849.
English Abstract of CN2641451, Sep. 15, 2004.
English Abstract of CN2644878.
English Abstract of CN2677742, Feb. 9, 2005.
English Abstract of TW549590, Aug. 21, 2003.
English Abstract of CN1335047, Feb. 6, 2002.
English Abstract of CN1524705, Sep. 1, 2004.
English Abstract of CN1605795, Apr. 13, 2005.
English Abstract of CN1622351, Jun. 1, 2005.
English Abstract of CN1731593, Jul. 26, 2006.
English Abstract of CN1447984, Oct. 8, 2003.
English Abstract of CN1808714, Jul. 26, 2006.
English Abstract of CN1830082, Sep. 6, 2006.
English Abstract of CN1840258, Oct. 4, 2006.
English Abstract of CN1866500, Nov. 22, 2006.
English Abstract of CN1869504, Nov. 29, 2006.
English Abstract of CN1874014, Dec. 6, 2006.
English Abstract of CN2458485, Nov. 7, 2001.
English Abstract of CN2634264, Aug. 18, 2004.
English Abstract of CN2881958, Mar. 21, 2007.
English Abstract of CN1788359, Jun. 14, 2006.
English Abstract of EP1067164, Jan. 10, 2001.
English Abstract of JP2005093097, Oct. 12, 2006.
English Abstract of WO2006002603, Jan. 12, 2006.
Non-Final Office Action in U.S. Appl. No. 11/887,433 mailed May 28, 2009.

* cited by examiner

ILLUMINATING EQUIPMENT USING HIGH POWER LED WITH HIGH EFFICIENCY OF HEAT DISSIPATION

This application is a continuation of co-pending U.S. utility application entitled "Illuminating Equipment Using High Power LED with High Efficiency of Heat Dissipation, " having Ser. No. 11/887,433, filed Sep. 28, 2007 which claims priority to PCT application entitled "Illuminating Equipment Using High Power LED with High Efficiency of Heat Dissipation", application no. PCT/CN2005000428, filed Mar. 31, 2005, which claims priority to Chinese patent application entitled "Illuminating Equipment Using High Power LED with High Efficiency of Heat Dissipation" application no. 2005/20004571.9, filed Mar. 31, 2005 each of which is incorporated by reference herein in its entirety.

FIELD OF THE INVENTION

The present invention relates to a packaged system; the packaged system is for packaging a light-emitting apparatus and is capable of further integrating an illuminating equipment. Particularly, the present invention relates to a packaged system; the packaged system is for packaging the high power LED, and it provides a highly efficient heat-dissipating apparatus and collocates the integrated power supply and the reflector apparatus for further applications on various projecting illuminating equipments, such as a flashlight or floodlight.

BACKGROUND OF THE INVENTION

Presently, there are many manufacturers who invest in manufacturing high illumination LED packages with different shapes. The difference between the high illumination LED packages and the traditional LED bulbs is that the high illumination LED uses larger emitter chip, but it also correspondingly causes higher power requirement. In general, the packages are originally designed to replace the traditional bulbs. However, as a result of the shape, the dimension, and the power requirement of the high illumination LED, the LED manufacturers have encountered unexpected difficulties on manufacturing. An example of the kind of the high illumination LED is Luxeon™ Emitter Assembly LED (Luxeon is the registered trademark of the Lumileds Lighting, LLC.). Although the package is capable of generating higher illumination than the traditional LED bulb, it also generates a greater amount of heat. If the heat can not be dissipated effectively, the emitter chip may be damaged.

In general, in order to overcome the problems of heat generated by the LED package, the LED manufacturers will incorporate a heat-dissipating channel into the LED package. For example, Luxeon LED is incorporated with a metal heat dissipation board, and the metal heat dissipation board is disposed at the back of the LED package for conducting heat. In practical application, a much more ideal solution is to let the metal board further contact a heat dissipation surface for effectively cooling the LED package. In prior art, there have been trials in which these LED packages incorporate with other components. For example, the manufacturers who use Luxeon LED try to incorporate the Luxeon LED with a circuit board. The circuit board disposes many heat-conducting boards near the mount point of the LED for maintaining the cool effect of the heat-dissipating channel of the LED. Although these components are capable of dissipating heat effectively, their volume is often too large to be incorporated into compact illuminating equipments, such as a flashlight or floodlight. At the same time, because the circuit board which disposes heat-conducting boards also includes many other heat sink material, it is very difficult to weld the heat-conducting board with the circuit board without applying a great deal of heat.

Accordingly, it is necessary to provide a component which is capable of mounting on the high illumination LED and includes a good heat-dissipating apparatus. Moreover, the components also have the capability of further being integrated into illuminating equipments.

SUMMARY OF THE INVENTION

A scope of the present invention provides an illuminating equipment using the high power LED with highly efficient heat dissipation for preventing the efficiency of illumination of the high power LED from being reduced.

Another scope of the present invention provides a packaged system; the packaged system is for packaging the high power LED, and it provides the heat-dissipating apparatus with high efficiency. The packaged system is suitable for being disposed into a housing, and various projecting illuminating equipments are constructed by further integrating the power supply and the optical reflector apparatus. In other words, the packaged system has the plug and play (also called PnP) function.

The illuminating equipment, according to a preferred embodiment of the present invention, includes a housing, a reflector, a packaged system, and a power supply. The housing thereon defines a head end. The reflector is disposed in the housing and near the head end, and it has an aperture. The packaged system is disposed in the housing and includes a casing, a heat-conducting device, at least one heat-dissipating fin, and a light-emitting apparatus. The heat-conducting device which is disposed in the casing has a flat portion at one end, and the heat-conducting device is a hollow chamber, a working fluid and a capillary structure are disposed therein. The at least one heat-dissipating fin is disposed in the casing and mounted on the periphery of the heat-conducting device. The light-emitting apparatus is mounted on the flat portion of the heat-conducting device and disposed through the aperture to an optical center of the reflector for emitting a light in a form of point light source, wherein the heat which is generated during the operation of the light-emitting apparatus is conducted by the flat portion to the at least one heat-dissipating fin, and then it is dissipated by the at least one heat-dissipating fin. The power supply which is electrically connected to the light-emitting apparatus is used for providing the light-emitting apparatus with power when emitting light. The power supply can be disposed inside or outside the casing.

The efficiency of heat dissipation of the illuminating equipment, according to the present invention, is greatly increased. Although the illuminating equipment adopts high power LED, a great deal of heat which is generated during light emitting can be effectively dissipated by the heat-conducting device and the heat-dissipating fin to maintain the emitting efficiency of the LED. Moreover, the present invention provides a plug and play packaged system which is suitable for various illuminating equipment, and users can easily install and replace the packaged system.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

FIG. 8 illustrates an embodiment of the heat-dissipating fin according to the present invention, and the heat-dissipating fin is disk-like.

DETAILED DESCRIPTION OF THE INVENTION

The purpose of the present invention is to provide a packaged system; the packaged system is for packaging a light-emitting apparatus and is capable of further integrating in an illuminating equipment. Particularly, the present invention relates to a packaged system; the packaged system is used for packaging the high power LED, it also provides a highly efficient heat-dissipating apparatus and collocates the integrated power supply and the reflector apparatus for further applications on various projecting illuminating equipments, such as a flashlight or floodlight. The preferred embodiments according to the present invention will be described in detail as follows.

Figure 1A:
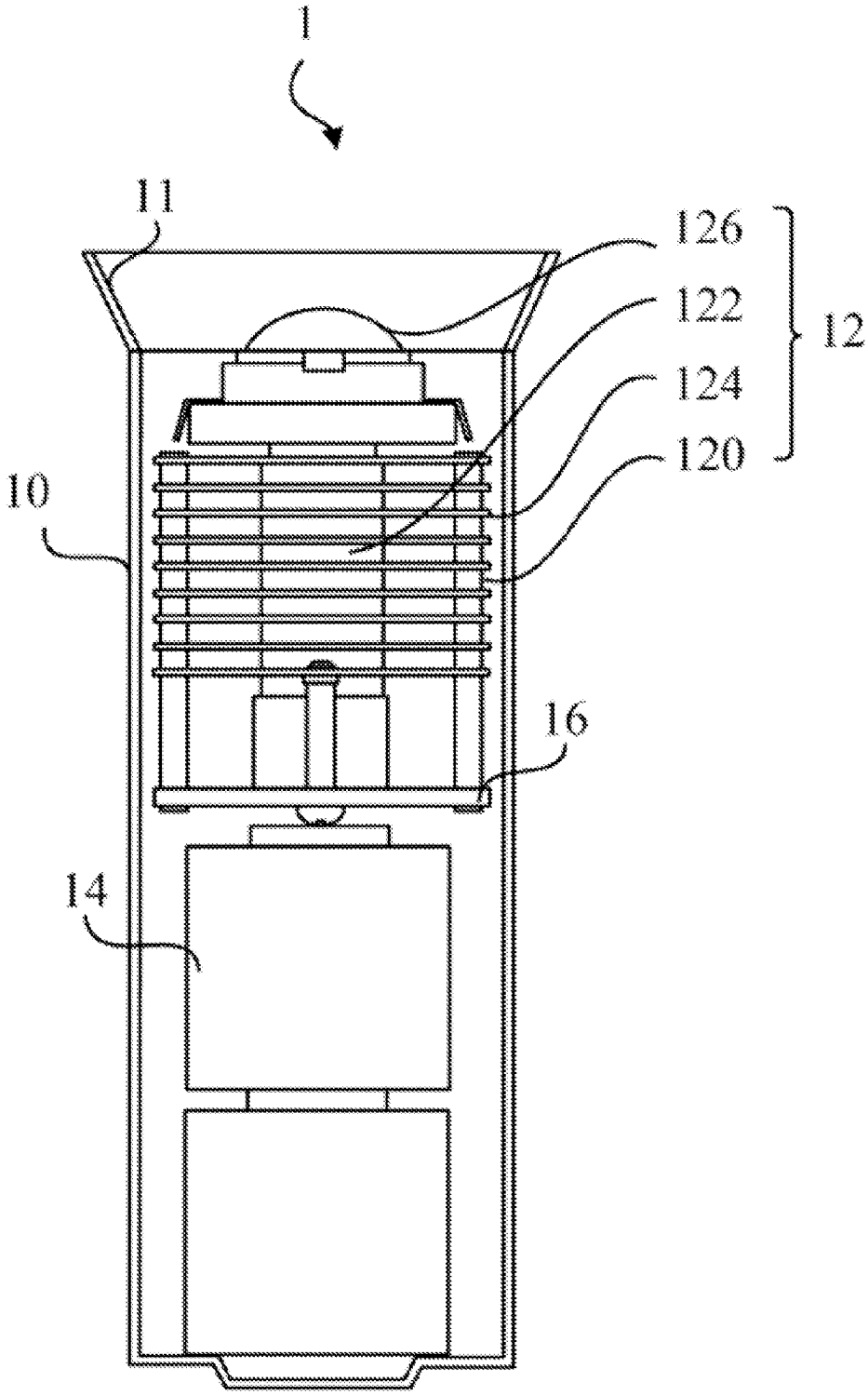
FIG. 1A is a cross-sectional view of the illuminating equipment according to the first preferred embodiment of the invention.

Referring to FIG. 1A, FIG. 1A is a cross-sectional view of the illuminating equipment 1 according to the first preferred embodiment of the invention. The illuminating equipment 1 comprises a housing 10, a reflector 11, a packaged system 12, and a power supply 14. The housing 10 thereon defines a head end. The reflector 11 is disposed in the housing 10 and near the head end, and it has an aperture. The packaged system 12 is disposed in the housing 10 and comprises a casing 120, a heat-conducting device 122, at least one heat-dissipating fin 124, and a light-emitting apparatus 126.

As shown in FIG. 1A, the heat-conducting device 122 is disposed in the casing 120, and it has a flat portion. The heat-conducting device 122 is a hollow chamber; a working fluid and a capillary structure are disposed therein. In one embodiment, the heat-conducting device 122 is a heat pipe or a heat column, and the flat portion has extra processing during the manufacturing processes of the heat conductor. The at least one heat-dissipating fin 124 is disposed in the casing 120 and is mounted on the periphery of the heat-conducting device 122 for increasing the efficiency of heat dissipation. The light-emitting apparatus 126 is mounted on the flat portion of the heat-conducting device 122 and is disposed through the aperture to an optical center of the reflector 11, for emitting a light in a form of point light source, wherein the heat, generated during the operation of the light-emitting apparatus 126, is conducted by the flat portion of the heat conducting device 122 to the at least one heat-dissipating fin 124, and then it is dissipated by the at least one heat-dissipating fin 124. A circuit board 16 is disposed on another end of the heat-conducting device 122 in the housing 10, and it is electrically connected to the light-emitting apparatus 126 and the power supply 14 for controlling the light-emitting apparatus 126 to emit light. The power supply 14 is disposed in the housing 10 and is electrically connected to the circuit board 16 via an electric line (not shown in FIG. 1A) for providing the light-emitting apparatus 126 with the power when emitting light. In one embodiment, the reflector 11 reflects the light emitted by the light-emitting apparatus 126 to the outside of the housing 10. The power supply 14 comprises at least one battery.

Figure 1B:
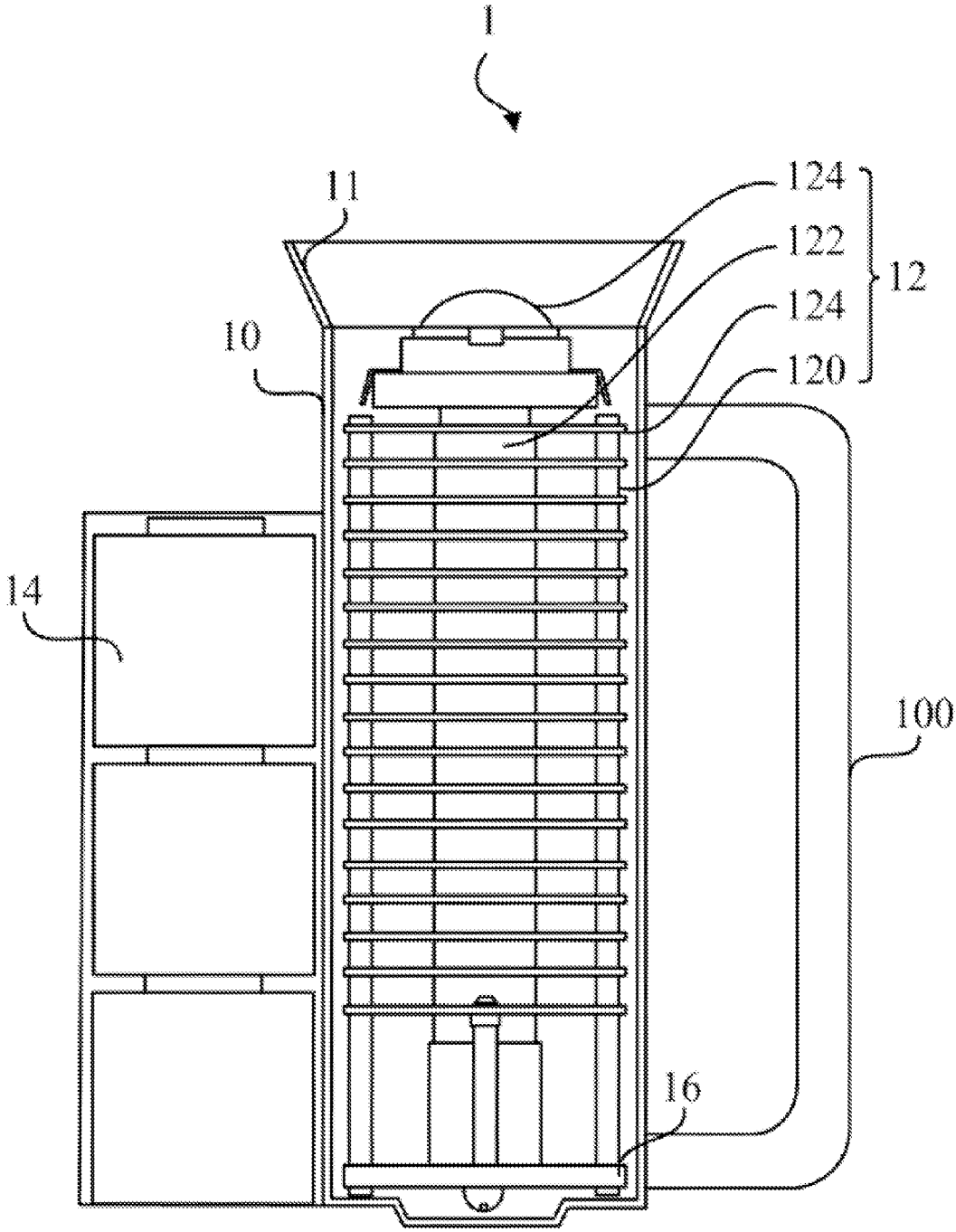
FIG. 1B is a cross-sectional view of the illuminating equipment according to the second preferred embodiment of the invention.

FIG. 1B is a cross-sectional view of the illuminating equipment 1 according to the second preferred embodiment of the invention. As shown in FIG. 1B, FIG. 1B and FIG. 1A have units with the same notations to execute the same functions, so unnecessary details will not be repeated here. In the preferred embodiment, the housing 10 provides a handle 100 on an upper edge thereof, and a larger space is configured under the housing 10 for disposing the power supply 14. For providing the illuminating equipment 1 higher power input, the power supply 14 can comprise more batteries or other rechargeable devices.

Figure 2A:
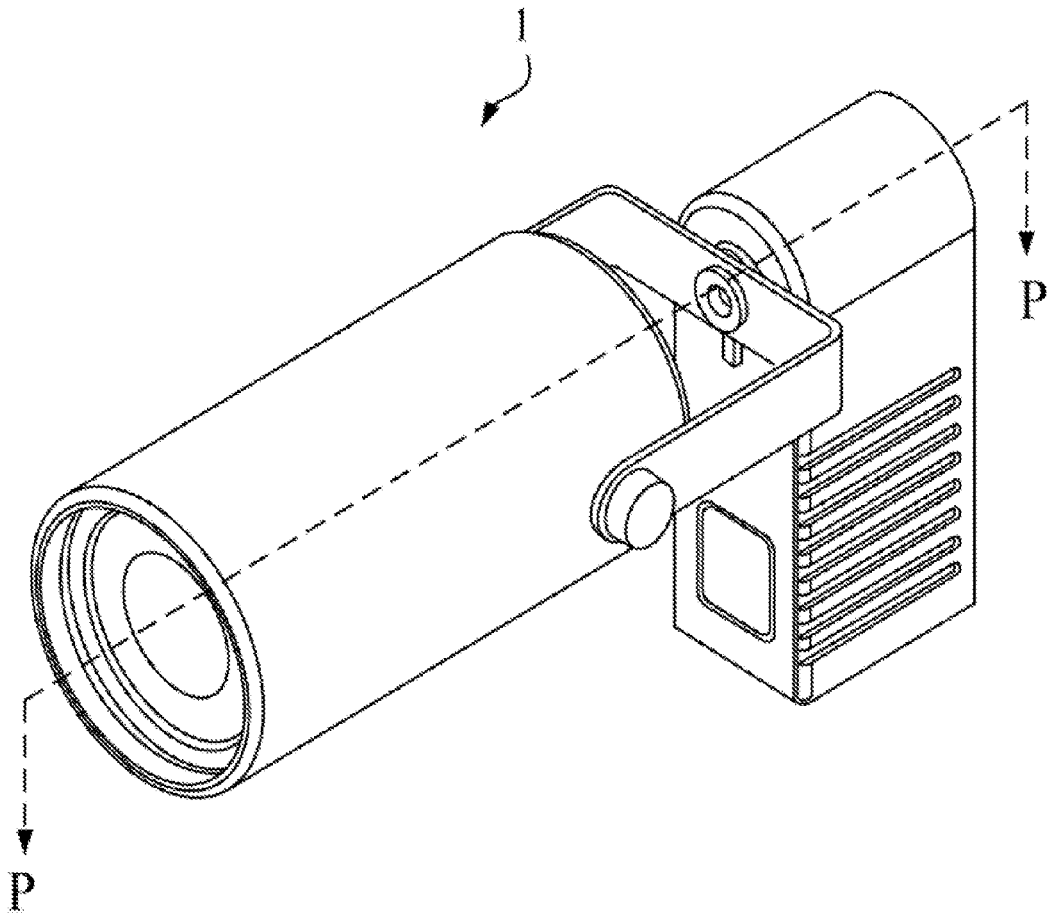
FIG. 2A is an outside perspective view of the illuminating equipment according to the third preferred embodiment of the invention.
Figure 2B:
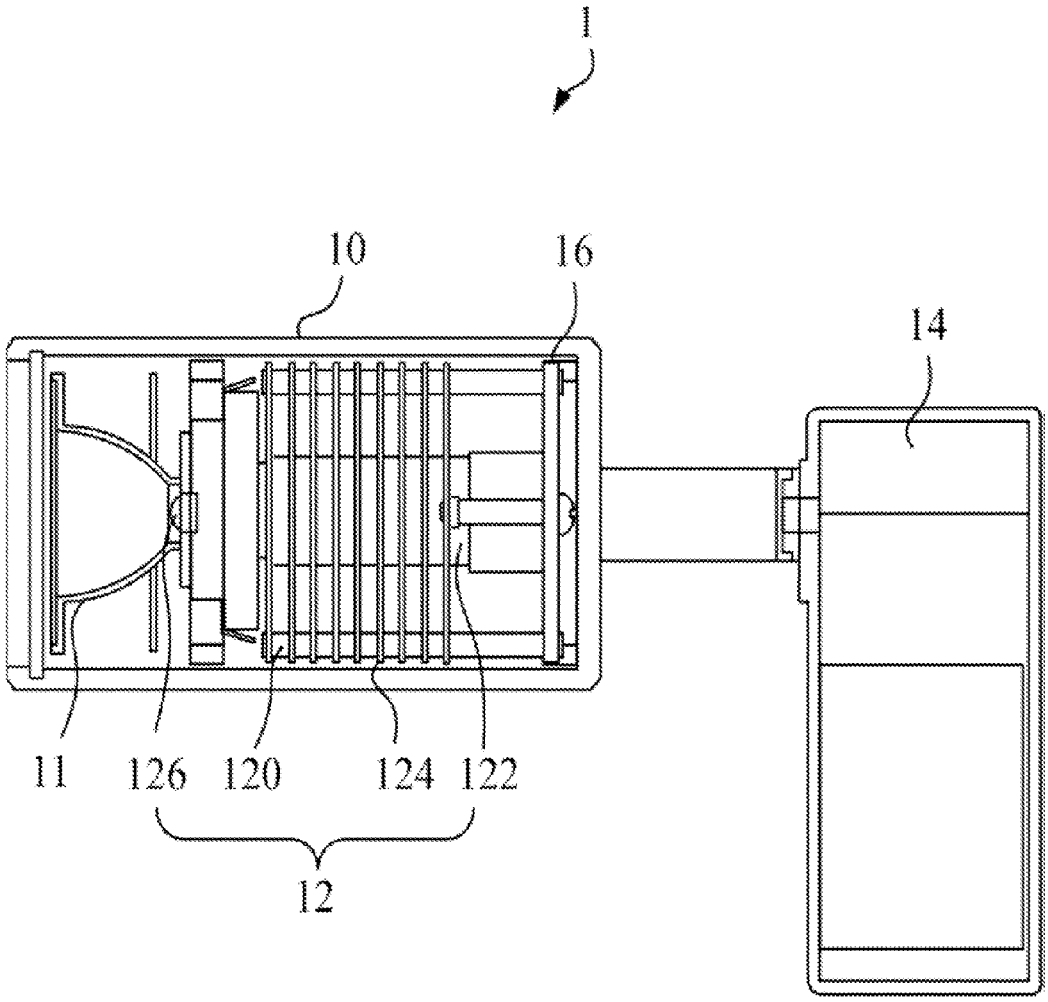
FIG. 2B is a cross-sectional view in FIG. 2A along the P-P line showing the illuminating equipment.
Figure 2C:
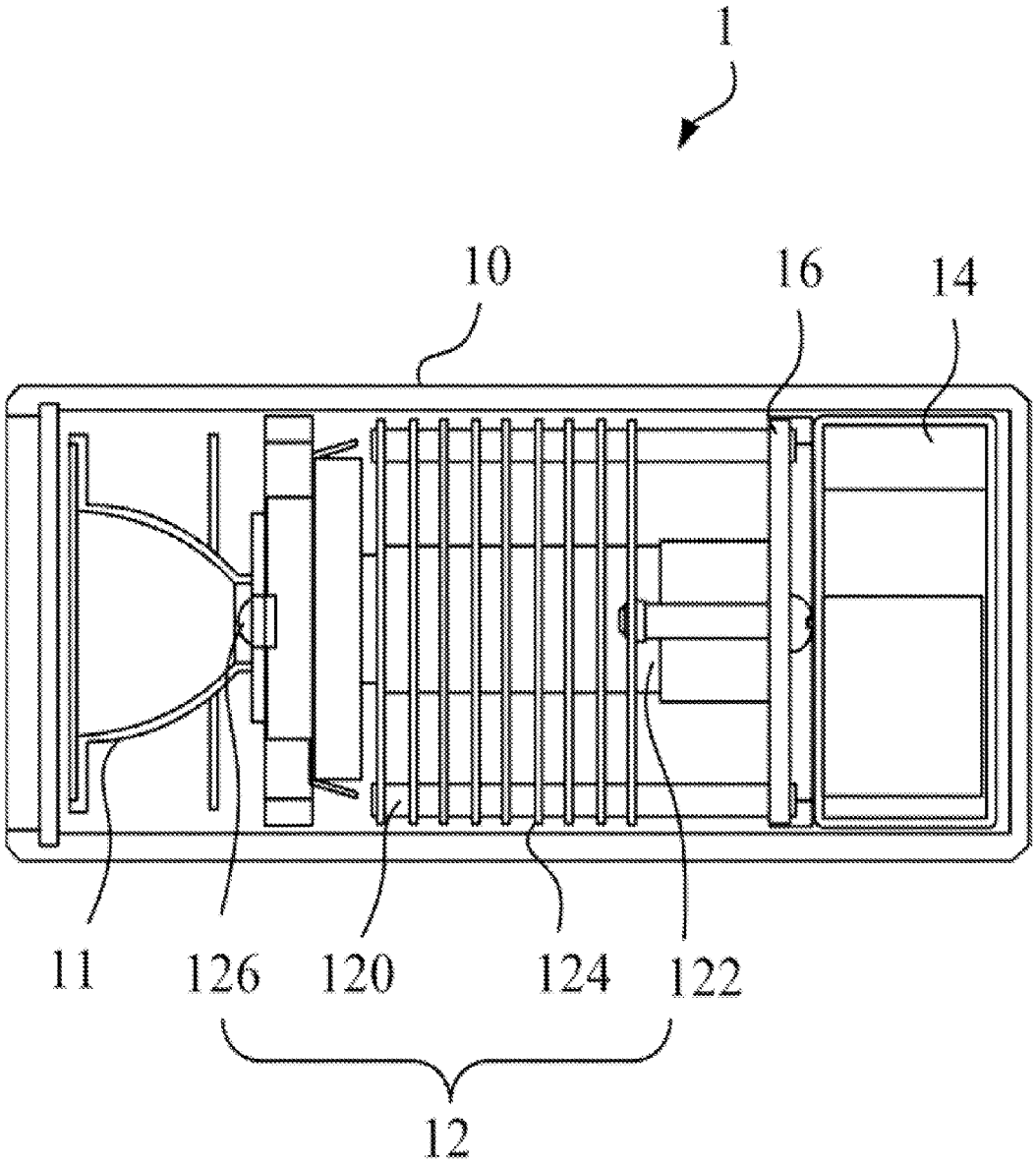
FIG. 2C shows another embodiment of the illuminating equipment in FIG. 2B.

Referring to FIG. 2A, FIG. 2A is an outside perspective view of the illuminating equipment 1 according to the third preferred embodiment of the invention. FIG. 2B is a cross-sectional view of FIG. 2A along the P-P line showing the illuminating equipment 1. FIG. 2C shows another embodiment of the illuminating equipment 1 in FIG. 2B. As shown in FIG. 2B, FIG. 2B and FIG. 1A have the units with the same notations to execute the same functions, so unnecessary details will not be repeated here. As shown in FIG. 2B and FIG. 2C, the power supply 14 can connect to the housing 10 from the outside or dispose in the housing 10. In one embodiment, the power supply 14 can be a power source for transforming D.C. power to A.C. power.

Figure 3:
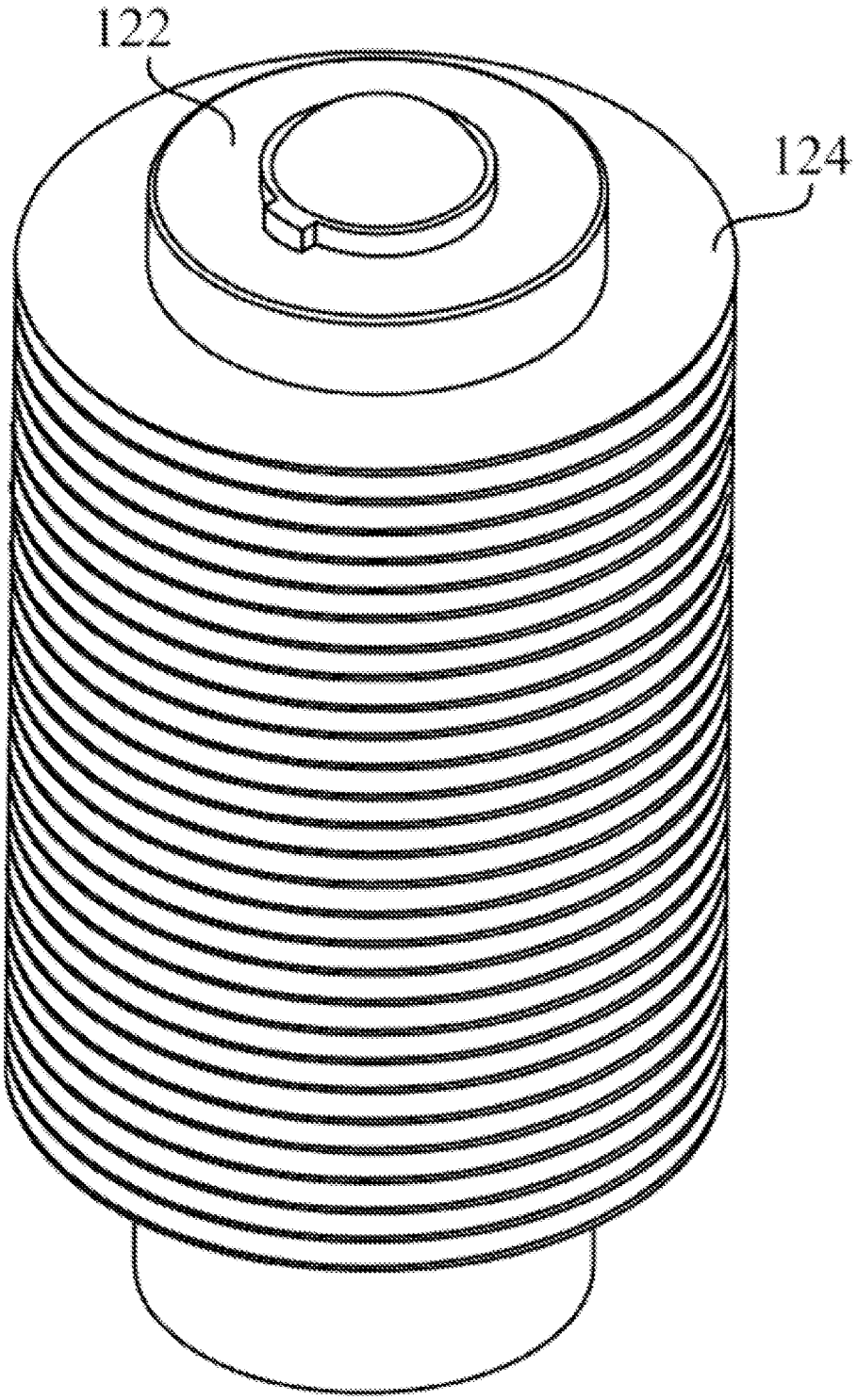
FIG. 3 is a three-dimensional view of the heat-conducting device and the at least one heat-dissipating fin according to an embodiment of the invention.
Figure 4:
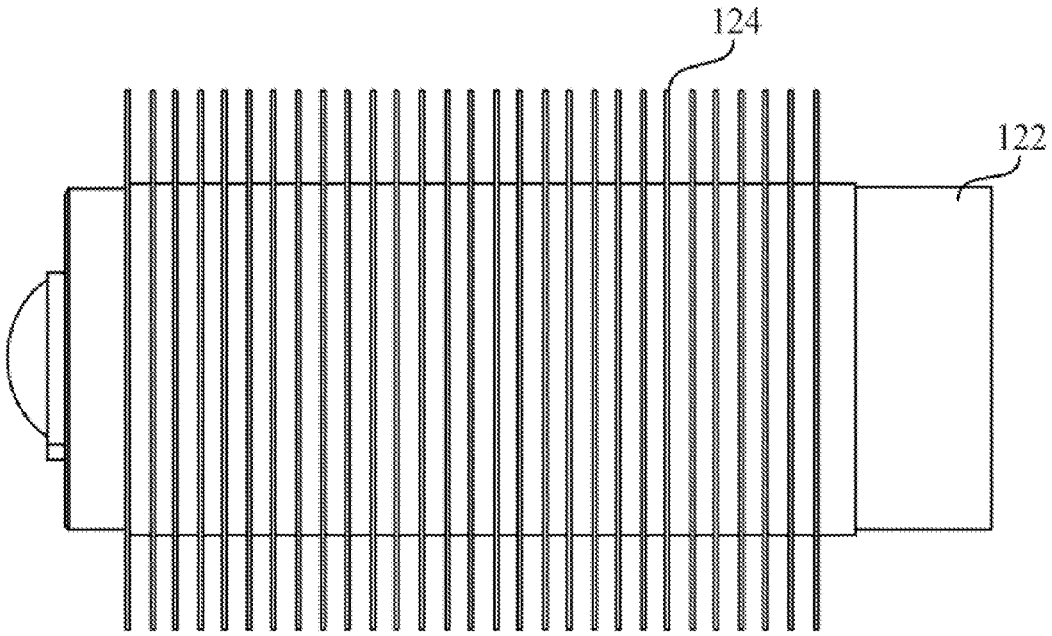
FIG. 4 is a side view of the heat-conducting device and the at least one heat-dissipating fin according to an embodiment of the invention.

FIG. 3 and FIG. 4 are a three-dimensional view and a side view of the heat-conducting device 122 and the at least heat-dissipating fin 124 according to an embodiment of the invention. The heat-conducting 122 according to an embodiment of the invention adopts a heat-dissipating way using vapor cycle, and the working principles are described below. The heat-conducting device 122 is a hollow chamber, and a working fluid is placed therein. The material of the heat-conducting device 122 is copper. The hollow chamber is a vacuum, and a capillary structure (not shown in FIG. 3 and FIG. 4) is disposed inside. When one end of the hollow chamber is heated, the working fluid will absorb the heat and evaporate to become a vapor. The vapor can rapidly conduct the heat to the heat-dissipating fin 124 which is mounted on the periphery of the hollow chamber, and the heat-dissipating fin 124 further dissipate the heat out of the packaged system 12. The gaseous working fluid is condensed to become the liquid working fluid and absorbed back to the heated end of the hollow chamber to finish a thermal cycle. As described above, the heat-conducting device 122 collocated with the heat-dissipating fin 124 has high efficiency in heat dissipation.

Figure 5:
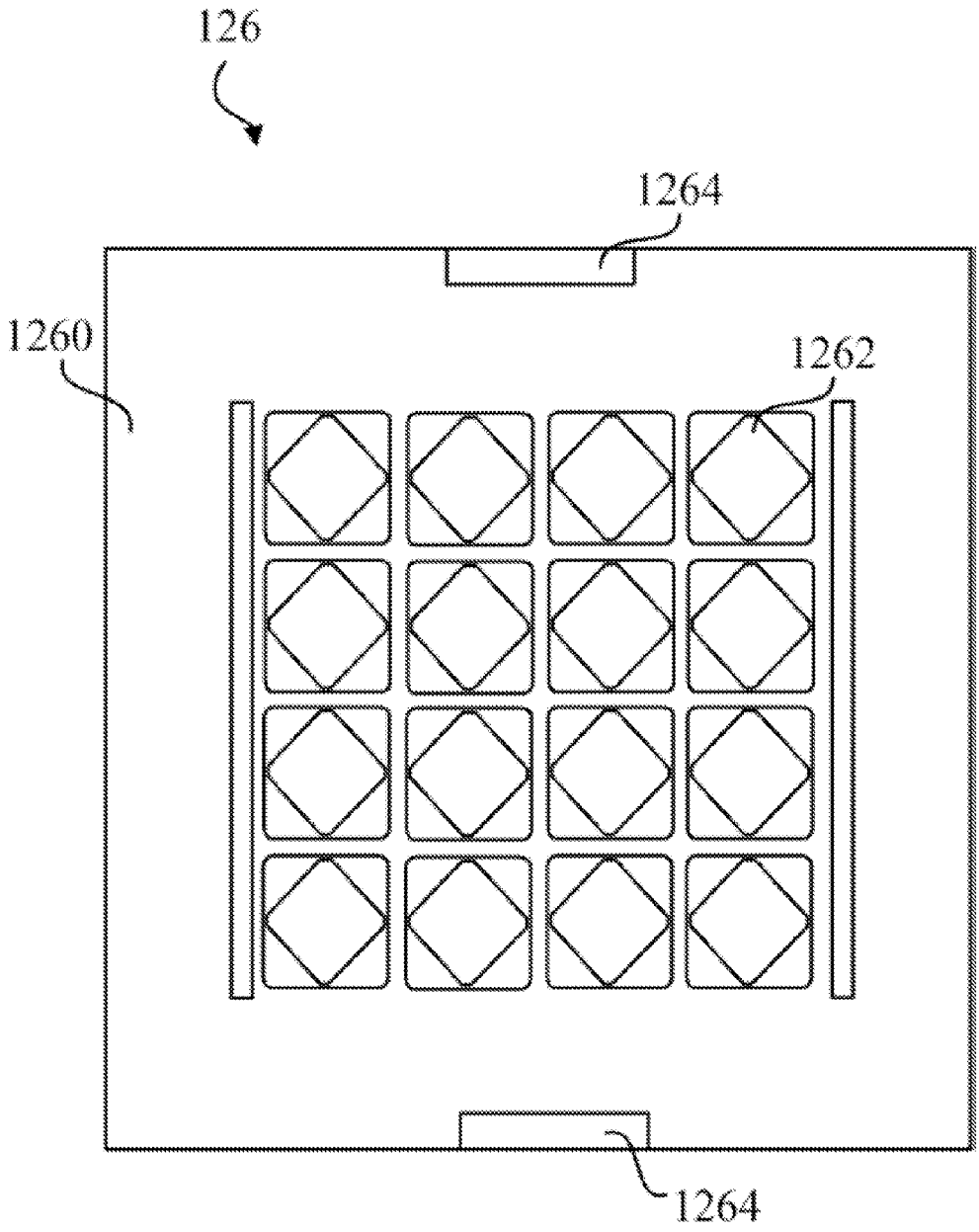
FIG. 5 is a vertical view of the light-emitting apparatus according to an embodiment of the invention.
Figure 6:
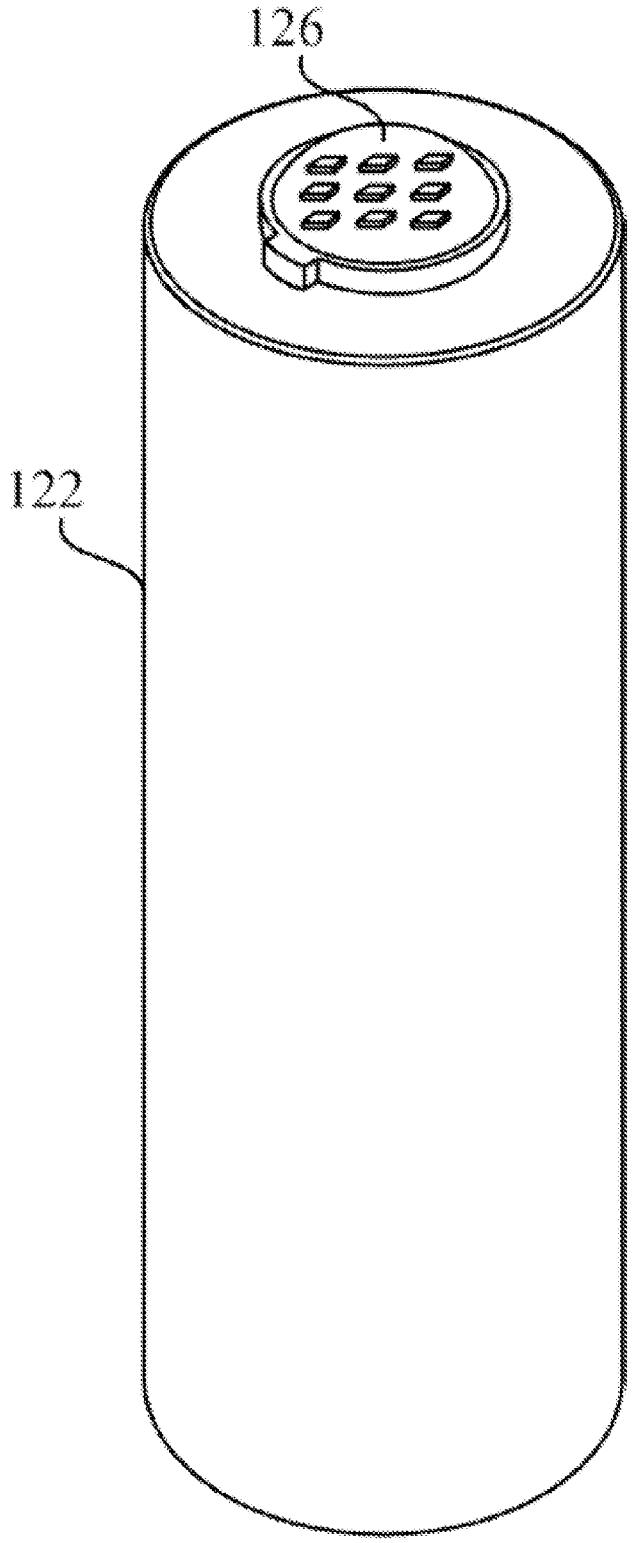
FIG. 6 shows the light-emitting apparatus according to an embodiment of the invention, and the light-emitting apparatus is mounted on the flat portion of the heat-conducting device.
Figure 7:
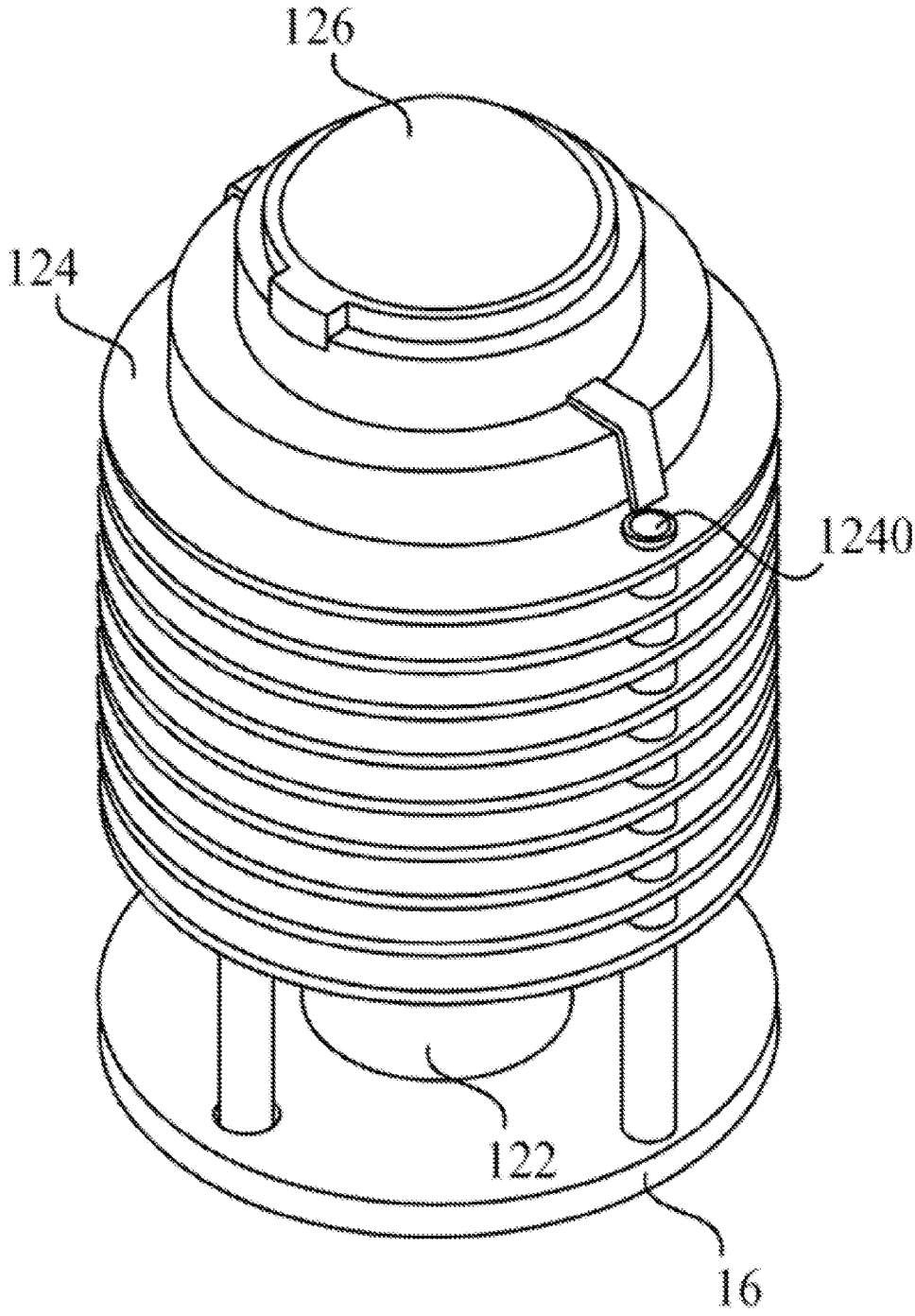
FIG. 7 illustrates an embodiment of the heat-dissipating fin according to the present invention, and the heat-dissipating fin has at least one formed-through hole through which at least electric line can pass.

Referring to FIG. 5 to FIG. 7, FIG. 5 is a vertical view of the light-emitting apparatus 126 according to an embodiment of the invention. The light-emitting apparatus 126 comprises a substrate 1260, at least one semiconductor light-emitting apparatus 1262, and two electrodes 1264. The at least one semiconductor light-emitting apparatus 1262 is disposed on the substrate 1260 for emitting the light. The two electrodes 1264 are respectively disposed on the substrate 1260 and electrically connected to each of the at least one semiconductor light-emitting apparatus 1262. In one embodiment, the substrate 1260 can be formed of a silicon material or a metal material, and each of the at least one semiconductor light-emitting apparatus 1262 is a light-emitting diode or a laser diode. Particularly, the light-emitting diodes have high power and high illumination. Notably, the light-emitting apparatus 126 according to the present invention packages the at least one semiconductor light-emitting apparatus 1262 into a single package, so the light-emitting apparatus 126 emits a light in a form of point light source. As shown in FIG. 6, the light-emitting apparatus 126 is mounted on the flat portion of the heat-conducting device 122. In practical application, the light-emitting apparatus 126 can be mounted on the flat portion of the heat-conducting device 122 by wire bonding or flipping chip. As shown in FIG. 7, each of the at least one heat-dissipating fin 124 has at least one formed-through hole 1240 through which at least one electric line is wired to the circuit board 16 and the light-emitting apparatus 126.

Figure 8:
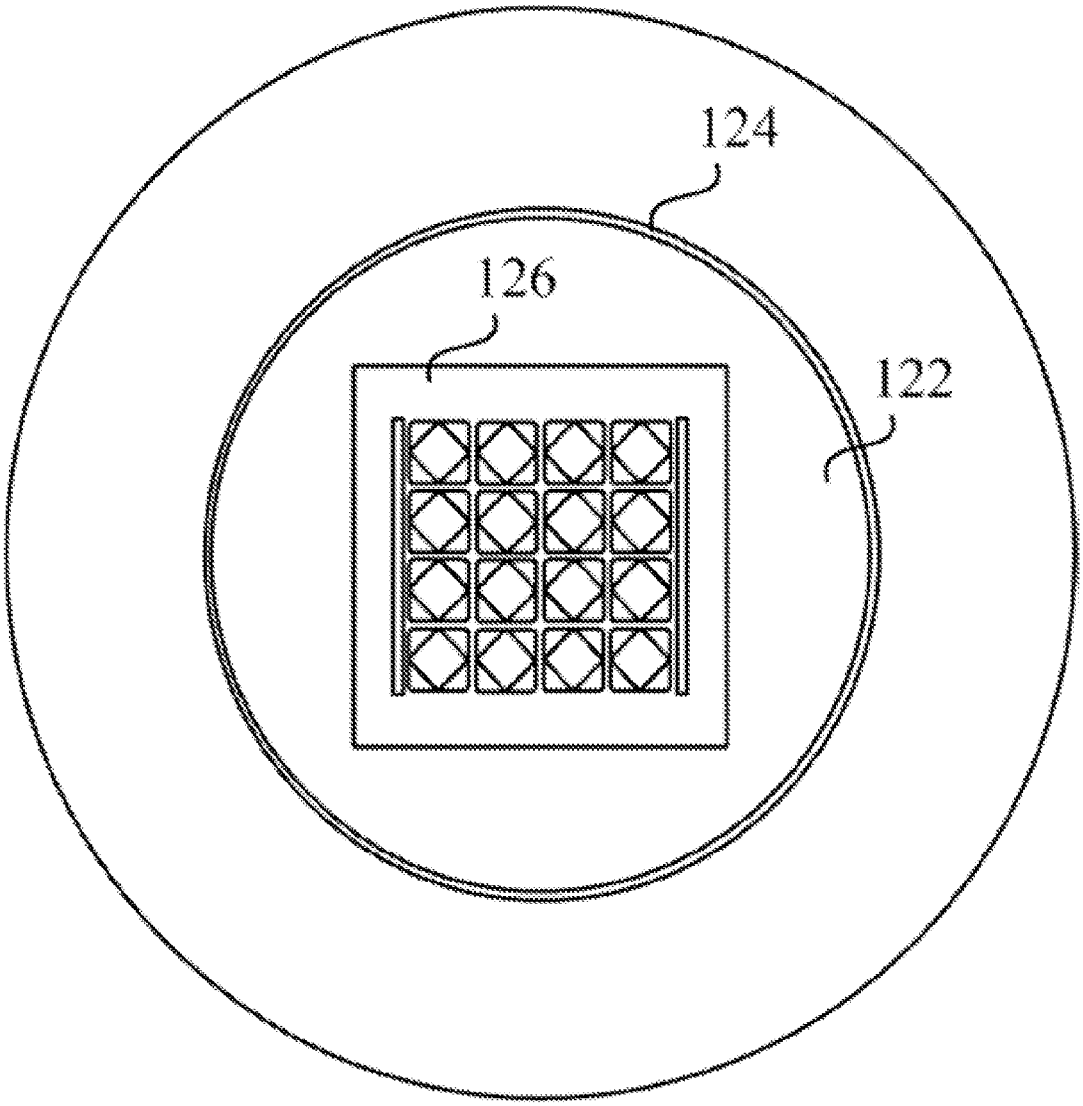
Figure 9:
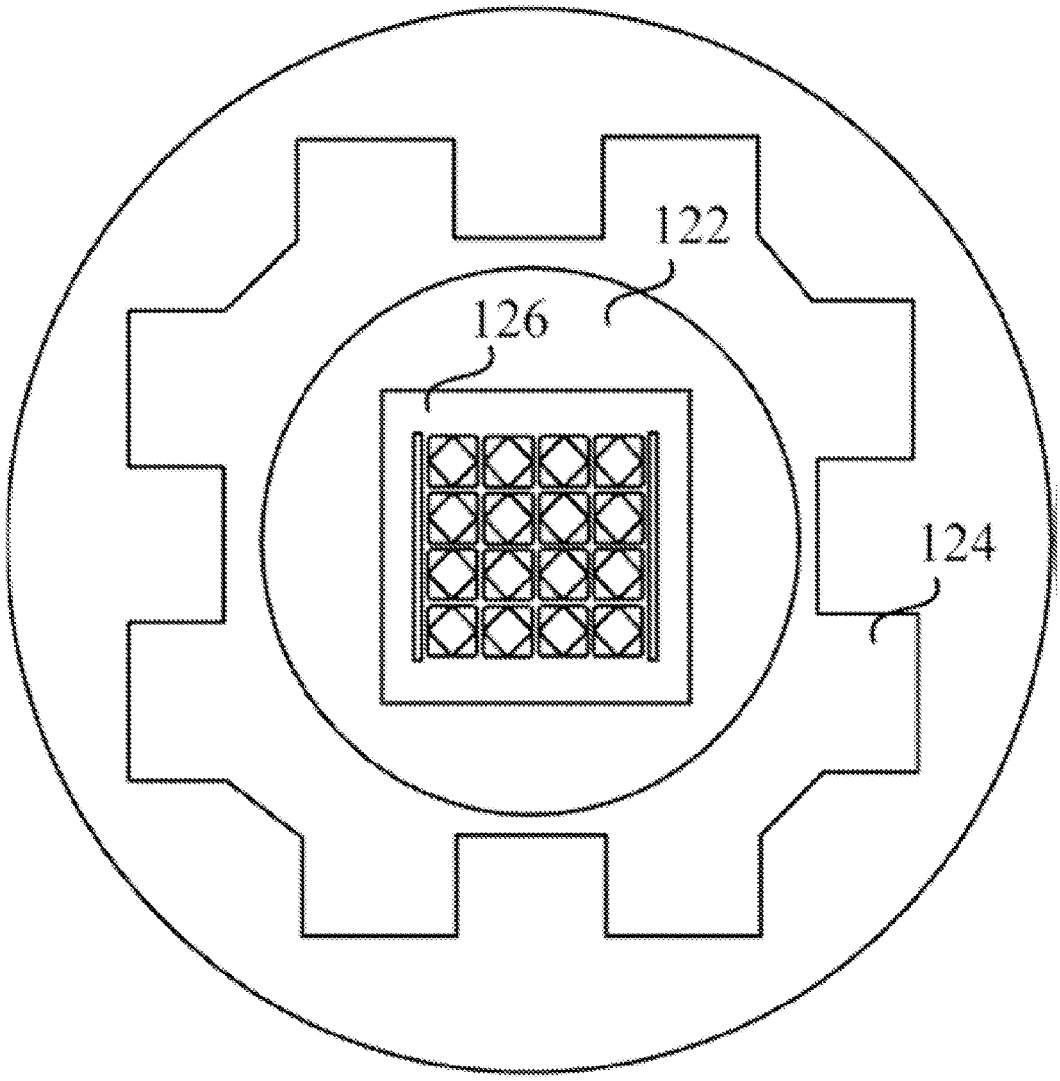
FIG. 9 illustrates an embodiment of the heat-dissipating fin according to the present invention, and the heat-dissipating fin is irregularly shaped.
Figure 10:
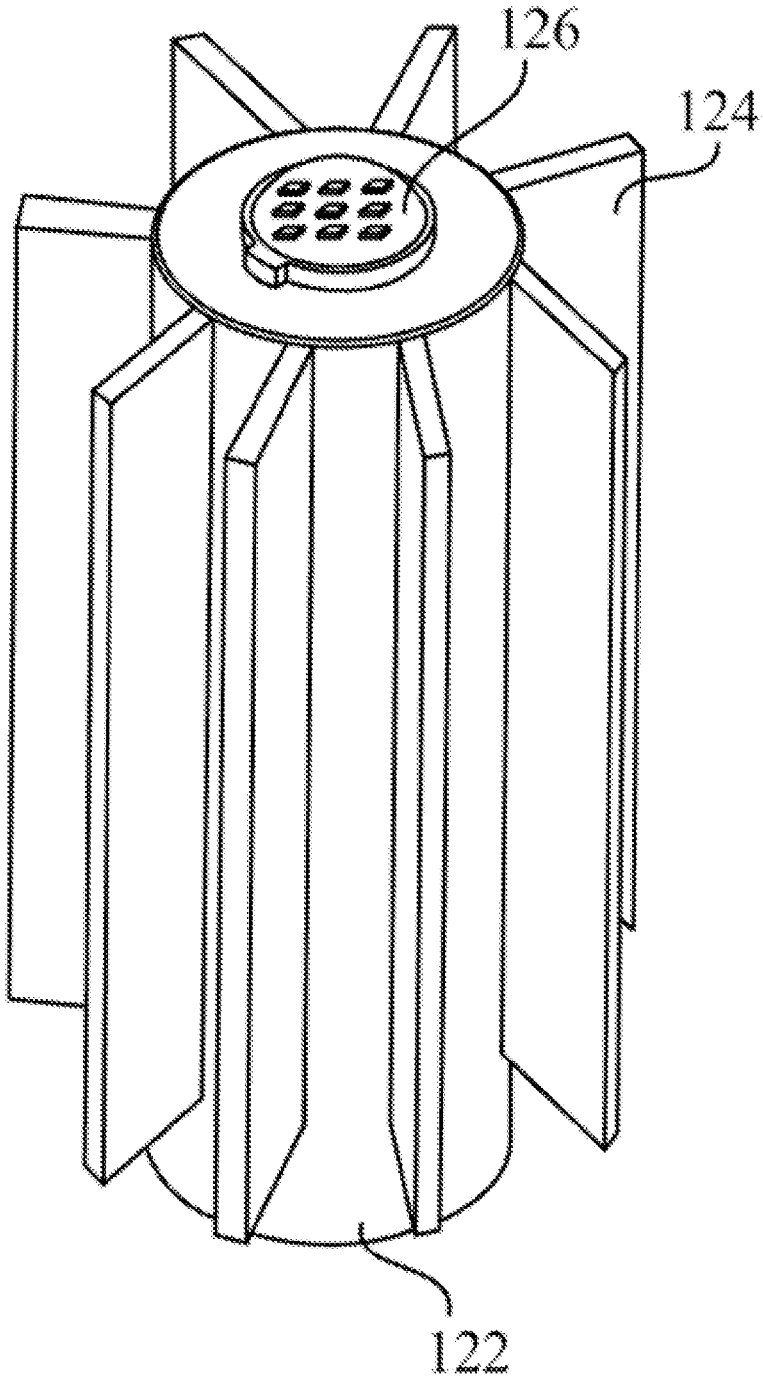
FIG. 10 illustrates an embodiment of the heat-dissipating fin according to the present invention, and the heat-dissipating fin is radial shaped.

Referring to FIG. 8 to FIG. 10, the heat-dissipating fin 124 has various embodiments. FIG. 8 illustrates an embodiment of the heat-dissipating fin 124 according to the present invention, and the heat-dissipating fin 124 is disk-like. As shown in FIG. 8, the heat-dissipating fin 124 can be irregularly shaped, such as saw-toothed shaped, petaloid shaped, or radial shaped (as shown in FIG. 9), and the capability of being disposed into the casing 120 is the primary principle. The heat-dissipating fin 124 therein can have open holes, and the material of the heat-dissipating fin 124 can be copper, aluminum, Magnesium and Aluminum Alloy, or other similar material.

Figure 11:
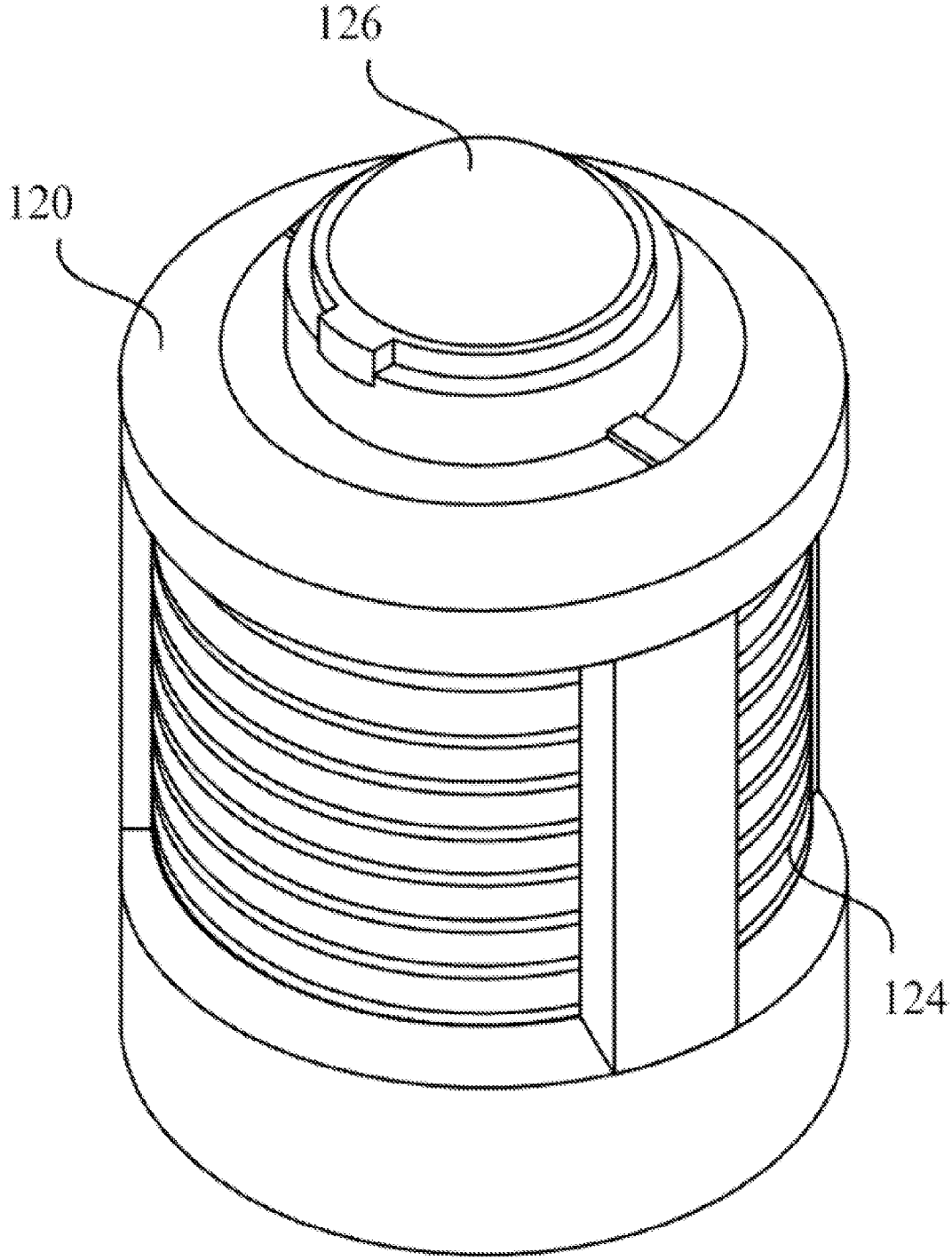
FIG. 11 illustrates that in order to increase the efficiency of heat dissipation of the packaged system according to the present invention, the casing thereon can provide a plurality of ventilating holes.
Figure 12A:
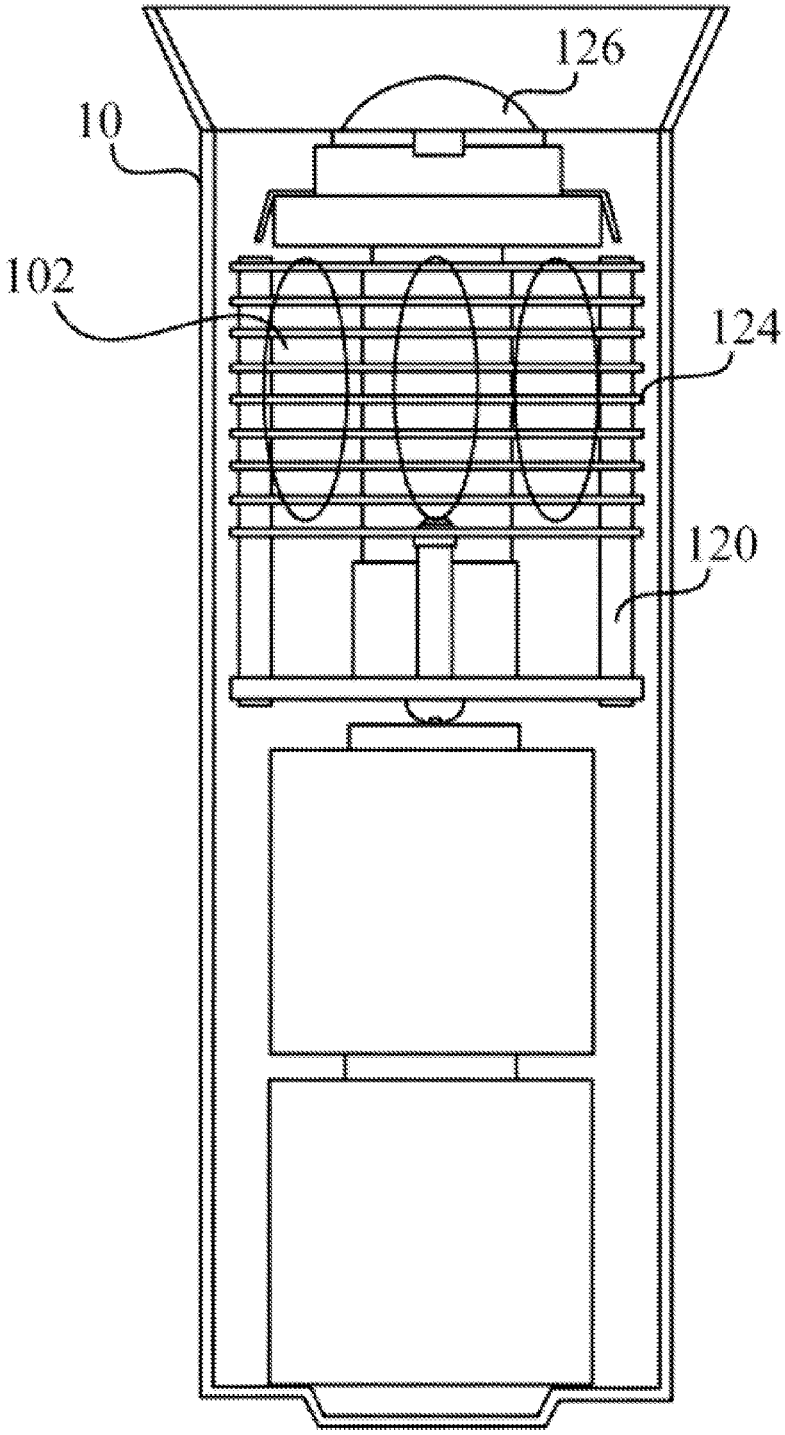
FIG. 12A illustrates that in order to increase the efficiency of heat dissipation of the illuminating equipment according to the first preferred embodiment of the present invention, the housing thereon can provide a plurality of ventilating holes.
Figure 12B:
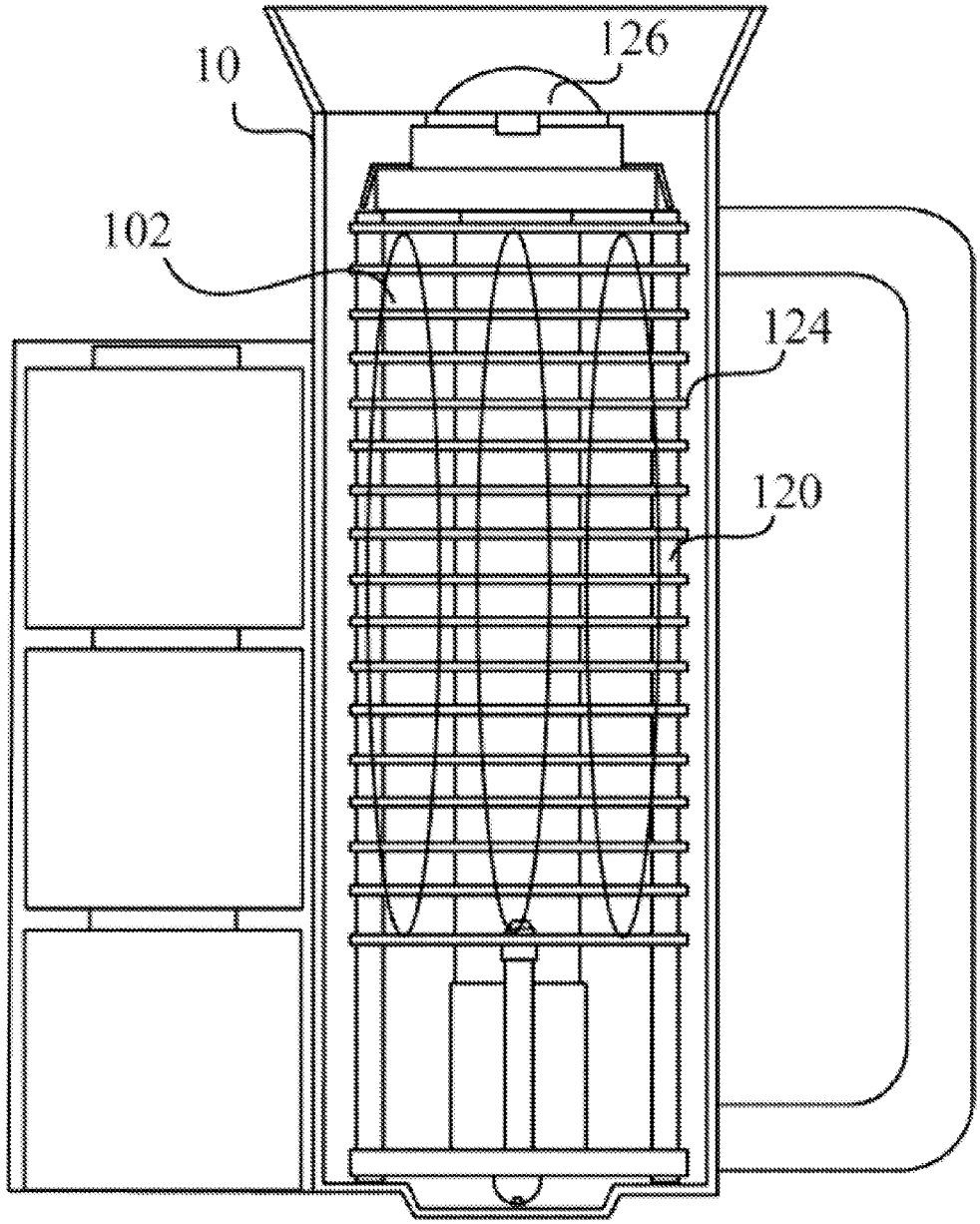
FIG. 12B illustrates that in order to increase the efficiency of heat dissipation of the illuminating equipment according to the second preferred embodiment of the present invention, the housing thereon can provide a plurality of ventilating holes.
Figure 12C:
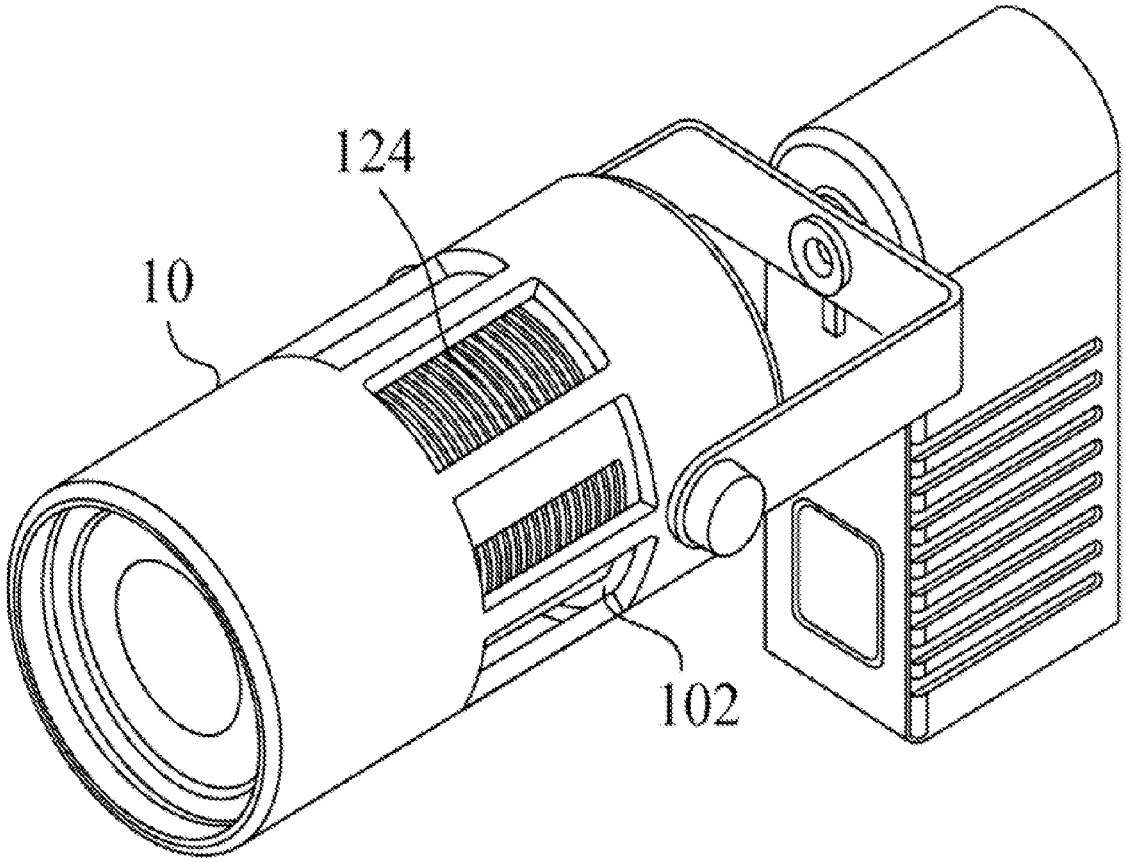
FIG. 12C illustrates that in order to increase the efficiency of heat dissipation of the illuminating equipment according to the third preferred embodiment of the present invention, the housing thereon can provide a plurality of ventilating holes.
Figure 12D:
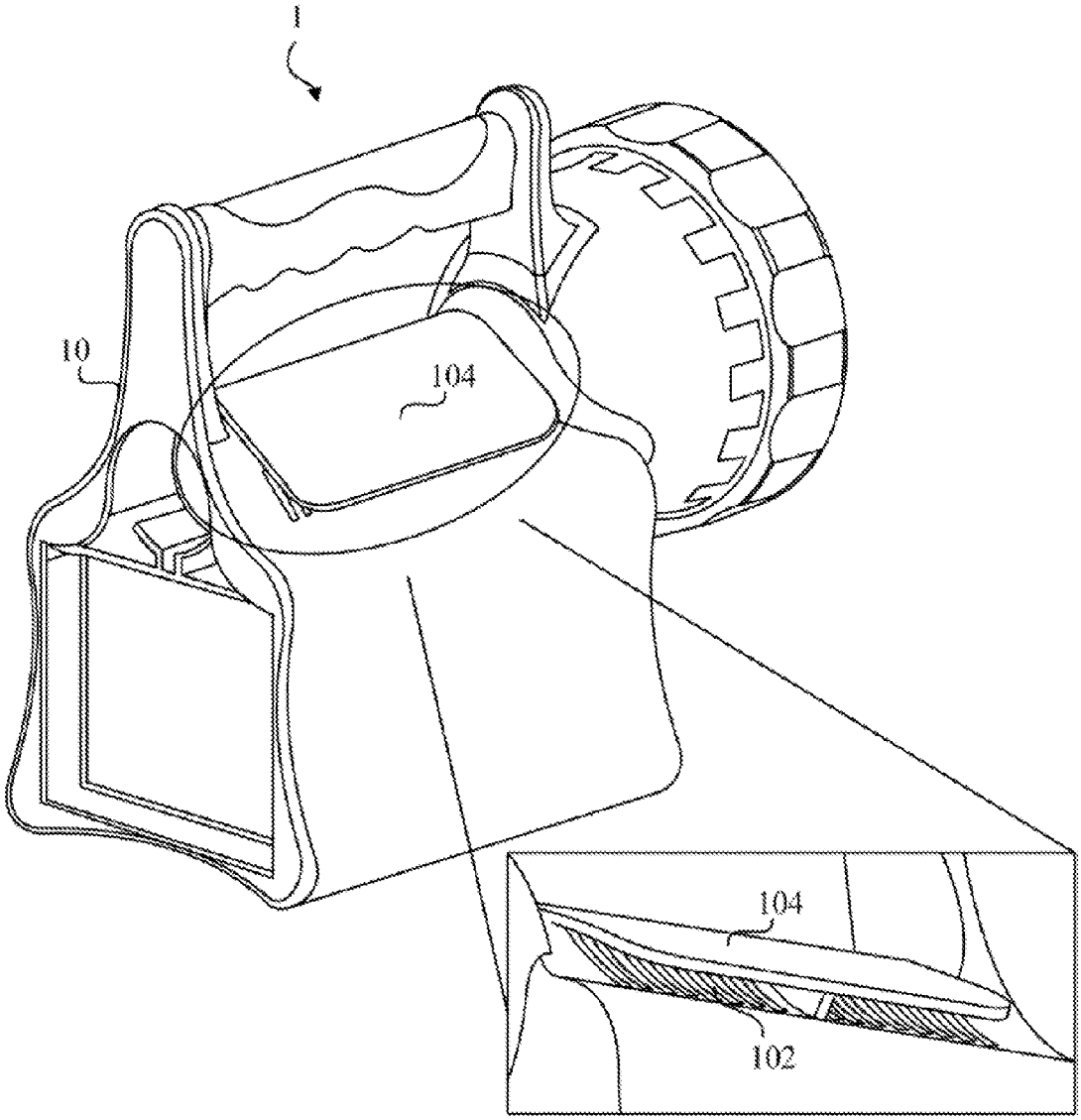
FIG. 12D is an exterior view and an enlarged partial view of the illuminating equipment according to the second preferred embodiment of the present invention, and the housing thereon provides a plurality of ventilating holes and disposes a flow-guiding board near the ventilating holes.

As shown in FIG. 11, in order to increase the efficiency of heat dissipation of the packaged system 12, the casing 120 thereon can provide a plurality of ventilating holes through which hot air in the housing 10 and the casing 120 induced by the heat is exhausted outside, thus increasing the efficiency of heat dissipation during the operation of the light-emitting apparatus 126. In order to achieve the same goal, as shown in FIG. 12A to FIG. 12C, the housing 10 thereon also provides a plurality of ventilating holes. In order to let the hot air exhaust out smoothly, each of the ventilating holes 102 of the casing 120 can correspond with the ventilating holes 102 of the housing 10, and the heat in the illuminating equipment 1 is exhausted out through the ventilating holes 102. FIG. 12D is an exterior view and an enlarged partial view of the illuminating equipment 1 according to the second preferred embodiment of the present invention. As shown in FIG. 12D, the housing 10 thereon provides a plurality of ventilating holes 102 and disposes a flow-guiding board 104 near the ventilating holes 102 for the hot air to flow along the flow-guiding board 104.

Figure 13A:
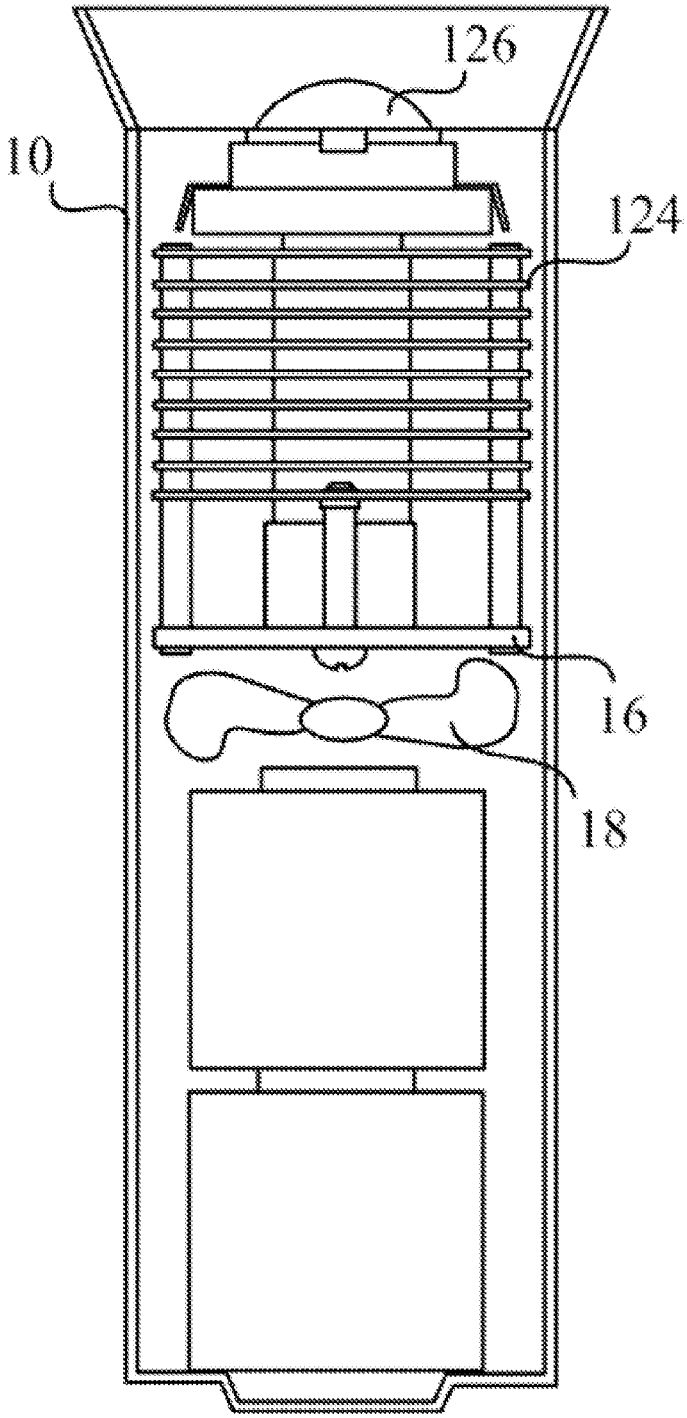
FIG. 13A illustrates that in order to increase the efficiency of heat dissipation of the illuminating equipment according to the first preferred embodiment of the present invention, a fan can be disposed in the housing.
Figure 13B:
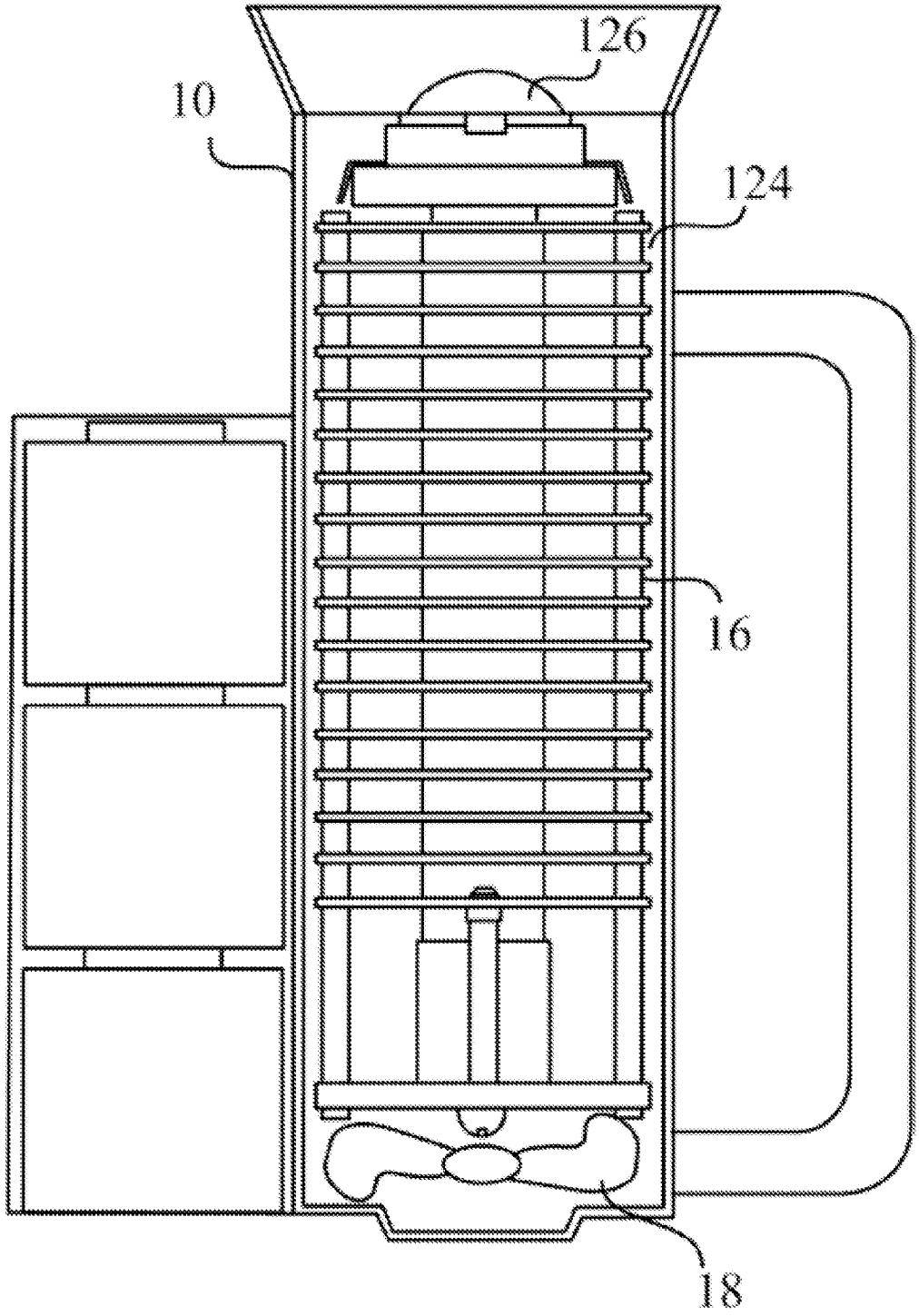
FIG. 13B illustrates that in order to increase the efficiency of heat dissipation of the illuminating equipment according to the second preferred embodiment of the present invention, a fan can be disposed in the housing.

As shown in FIG. 13A and FIG. 13B, in order to increase the efficiency of heat dissipation of the illuminating equipment 1, a fan 18 can be disposed at one end of the circuit board 16 in the housing 10. The fan 18 is electrically connected to the circuit board 16, and the circuit board 16 controls the switching-on or switching-off of the fan 18 by use of a controlling circuit. The controlling circuit (not shown in FIG. 13A and FIG. 13B) is operated by the circuit board 16 for detecting a temperature of the surrounding of the light-emitting apparatus 126. When the temperature is higher than a predefined value, the controlling circuit switches on the fan 18 for further cooling the light-emitting apparatus 126. Notably, FIG. 13A and FIG. 13B just show the first and the second preferred embodiments according to the present invention.

Figure 14A:
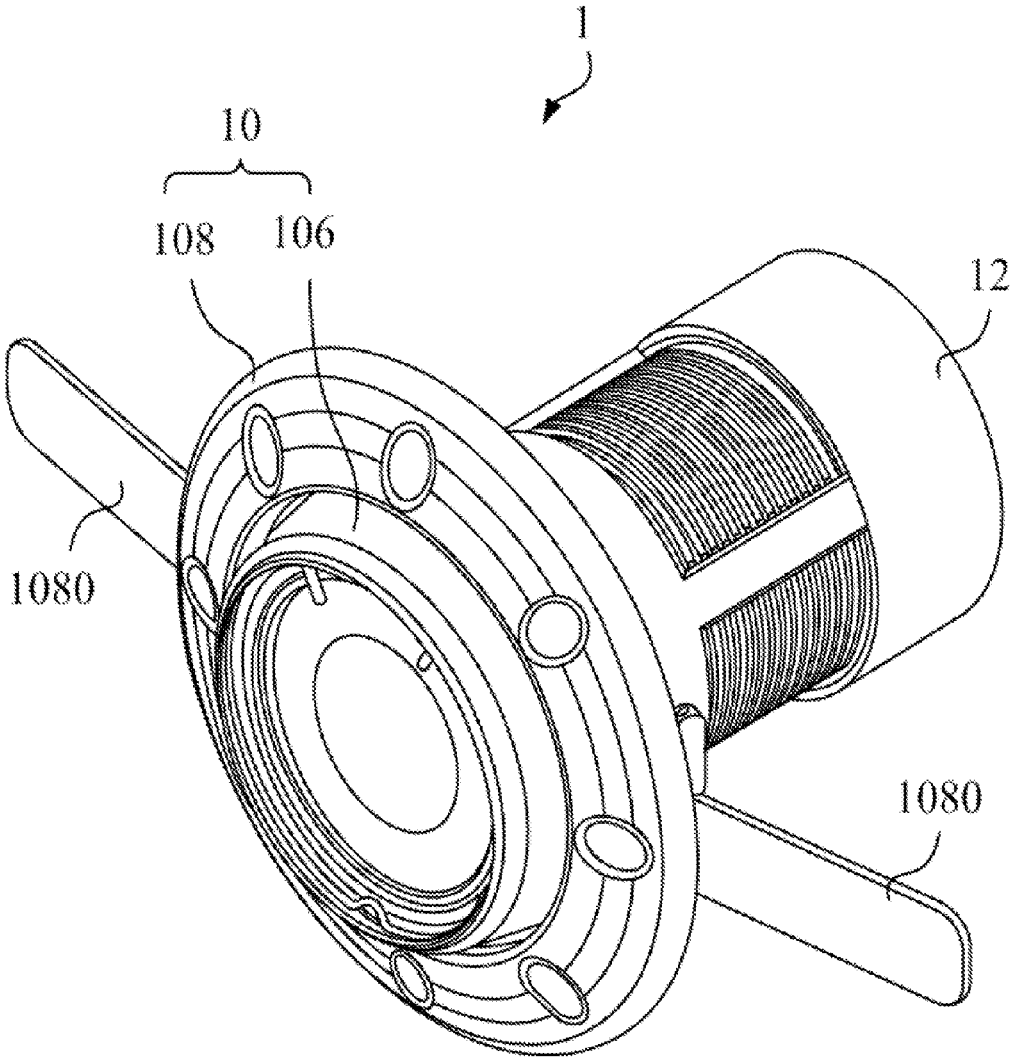
FIG. 14A is an exterior view of the illuminating equipment according to the fourth preferred embodiment of the present invention.
Figure 14B:
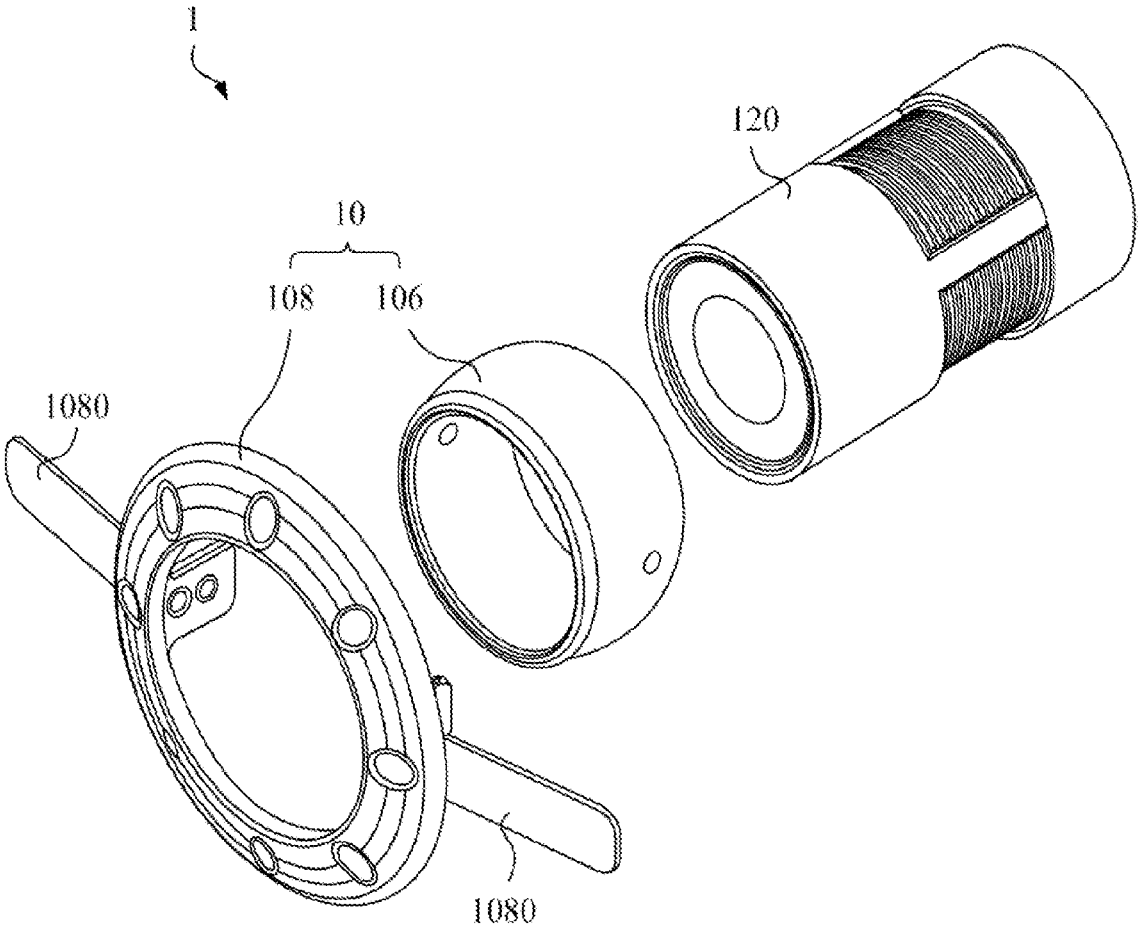
FIG. 14B is a blown up view in FIG. 14A showing the illuminating equipment.

Referring to FIG. 14A and FIG. 14B, FIG. 14A is an exterior view of the illuminating equipment 1 according to the fourth preferred embodiment of the present invention. FIG. 14B is a blown-up view of FIG. 14A showing the illuminating equipment 1. As shown in FIG. 14A, the housing 10 of the illuminating equipment 1 comprises a shell 106 and an embedding assembly 108. One end of the packaged system 12 is disposed in the shell 106 of the casing 10. The embedding assembly 108 is mounted on the shell 106, and the embedding assembly 108 thereon has two resilient bodies 1080 for the assembling of the illuminating equipment 1. For example, when users want to assemble the illuminating equipment 1 to a hole on a wall or a ceiling, users can first bend the two resilient bodies 1080 respectively to parallel with the casing 120 of the packaged system 12 and then embed the illuminating equipment 1 into the hole of the wall or the ceiling. When the illuminating equipment 1 is embedded into the hole, the two resilient bodies 1080 will restore to original state for clasping the illuminating equipment 1 into the hole.

The present invention provides a packaged system which has high efficiency of heat dissipation; the packaged system is for packaging a light-emitting apparatus and dissipating the heat, generated by the high illumination light-emitting diode, by the heat-conducting device and the heat-dissipating fin. The packaged system collocates the integrated power supply and the reflector apparatus for further applications on various projecting illuminating equipments.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An illuminating equipment, comprising:

a heat pipe having a flat portion, the heat pipe being a hollow chamber, therein placed a working fluid and disposed a capillary structure;

at least one heat-dissipating fin mounted on the periphery of the heat pipe; and a light-emitting apparatus, mounted on the flat portion of the heat pipe for emitting light, wherein a heat, generated during the operation of the light-emitting apparatus, is conducted by the flat portion of the heat pipe to the at least one heat-dissipating fin, and then is dissipated by the at least one heat-dissipating fin;

wherein the light-emitting apparatus comprises a substrate, with a plurality of positioning contours thereon, on the flat portion of the heat pipe, at least one semiconductor light-emitting apparatus disposed on the substrate and within one of the positioning contours for emitting the light, and two electrodes disposed on the substrate and electrically connected to each of the at least one semiconductor light-emitting apparatus.

2. The illuminating equipment of claim 1, wherein the substrate is formed of a silicon material.

3. The illuminating equipment of claim 1, wherein the substrate is formed of a metal material.

4. The illuminating equipment of claim 1, wherein each of the at least one semiconductor light-emitting apparatus is a light-emitting diode.

5. The illuminating equipment of claim 1, wherein each of the at least one heat-dissipating fin has at least one formed-through hole through which at least one electric line is wired to the light-emitting apparatus.

* * * * *